US006631252B2

(12) United States Patent
Ando et al.

(10) Patent No.: US 6,631,252 B2
(45) Date of Patent: Oct. 7, 2003

(54) FIXING APPARATUS CAPABLE OF CHANGING PRESSURE CONTACT FORCE

(75) Inventors: Masao Ando, Shizuoka (JP); Takahiro Azeta, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,339

(22) Filed: Oct. 24, 2001

(65) Prior Publication Data

US 2002/0051650 A1 May 2, 2002

(30) Foreign Application Priority Data

Oct. 31, 2000 (JP) ..... 2000-332698

(51) Int. Cl.[7] ..... G03G 15/20
(52) U.S. Cl. ..... 399/328; 219/216; 432/60
(58) Field of Search ..... 399/67, 328–331; 219/216; 432/60

(56) References Cited

U.S. PATENT DOCUMENTS 4,753,543 A * 6/1988 Mochimaru et al. .... 399/330 X
5,115,281 A 5/1992 Ohtsuka et al.
5,708,926 A * 1/1998 Sagara et al. ..... 399/328 X
5,826,141 A * 10/1998 Mitsuya ..... 399/328 X
6,032,949 A 3/2000 Ando ..... 271/225

FOREIGN PATENT DOCUMENTS

| | | |
|---|---|---|
| JP | 8-6426 | 1/1996 |
| JP | 10-250874 | 9/1998 |
| JP | 2000-66547 | 3/2000 |

* cited by examiner

*Primary Examiner*—William J. Royer
(74) *Attorney, Agent, or Firm*—Fitzpatrick, Cella, Harper & Scinto

(57) ABSTRACT

An object of the present invention is to provide a fixing apparatus that has a fixing rotator in contact with a recording material supporting an unfixed image, a pressure rotator in pressure contact with the fixing rotator, a support member supporting the pressure rotator and swingable around a plurality of fulcrums, an elastic member for biasing the support member so that the pressure rotator is biased to the fixing rotator, and pressure contact force changing device for changing a pressure contact force by swinging the support member against the biasing force of the elastic member, wherein the pressure contact force changing device can change the pressure contact force while the pressure rotator is in pressure contact with the fixing rotator.

8 Claims, 9 Drawing Sheets

FIXING APPARATUS CAPABLE OF CHANGING PRESSURE CONTACT FORCE

BACKGROUND OF THE INVENTION

1. Field of the Invention

The present invention relates to a fixing apparatus for fixing an image on a recording material by applying pressure, which is suitably used in image forming apparatuses such as copiers and printers employing electrophotographic and electrostatic recording systems.

2. Related Art

An image forming apparatus employing an electrophotographic system such as a copier, printer or facsimile forms an electrostatic latent image by charging the surface of an electrophotographic photosensitive body by means of a charging apparatus and exposing the surface of the charged electrophotographic photosensitive body by means of an exposing apparatus. The electrostatic latent image is developed by a developing apparatus to form a toner image which is transferred to a recording material such as paper by a transferring apparatus and then fixed on the recording material by a fixing apparatus as a permanent fixed image, and the fixed image is output.

FIG. 8 is a schematic diagram showing an image forming apparatus according to an embodiment of the present invention. The above-mentioned fixing apparatus operates as follows. A recording material P such as paper to which a toner image has been transferred by a transfer nip between a photosensitive drum 2 and a transfer roller 5 as an image carrier is conveyed while being held by a fixing nip formed between a heating roller 12 and a pressure roller 13 of a fixing apparatus 7 through a conveyance guide 9 and the unfixed toner image is thermally fixed on the recording material P as a permanently fixed image by heat from a heater (halogen heater) 14 incorporated in the heating roller 12 and pressure from the fixing nip. Other constituent elements of the image forming apparatus 1 will be described with reference to embodiments of the present invention which will be described below.

When an envelope is conveyed as a recording material in the image forming apparatus constituted as described above, if the envelope is nipped and conveyed while it is heated by the fixing apparatus, there arises a problem that it wrinkles. The envelope is formed by folding a single sheet of paper and pasting the overlapped portions. If there is a difference in shrinkage direction between the front side and the rear side of the sheet, there is no escaping for distortion at the time of shrinkage by heating, with the result that the sheet of paper is apt to wrinkle. To prevent wrinkling, a method making use of pressure means for reducing the contact pressure of the pressure roller is generally employed.

For example, FIG. 6 shows an example of a pressure mechanism for the fixing apparatus 7. The pressure mechanism comprises a heating roller 12 including a heater 14 (halogen heater), a pressure roller 13 contacting the heating roller 12, and a frame 52 supporting these components. Both ends of the heating roller 12 are rotatably supported by the frame 52 through the intermediation of a bearing (not shown). One end of the heating roller 12 is provided with a gear (not shown) to be driven by drive force transmitted from a drive source. Both ends of the pressure roller 13 are rotatably supported by a support member 15 through the intermediation of a bearing (not shown). Reference numeral 16 denotes a rotatable lever which is a contact pressure switching means and movably supported by a shaft 52*a* provided on either side of the frame 52. The rotatable lever 16 comprises an operation portion 16*a*, a contacting portion 16*b* contacting the support member 15 and a stopping portion 16*c* for stopping the movement of the rotatable lever 16. Reference numeral 60 denotes an elastic member made of a coil spring for biasing the support member 15 and provided between the frame 52 and the support member 15. An axis hole 15*a* which serves as a fulcrum is formed in the support member 15 so that the support member 15 is movably supported by a shaft 52*b* provided on either side of the frame 52. On the free end side of the support member 15 is formed a bending portion 15*b* which serves as a contacting potion with the above-mentioned rotatable lever 16 and the support portion of the above-mentioned elastic member 60.

When an envelope is to be conveyed, the rotatable lever 16 is first rotated clockwise as shown in FIG. 7. Since the contacting portion 16*b* of the rotatable lever 16 contacts the bending portion 15*b* of the support member 15, and the rotatable lever 16 is biased in the direction indicated by an arrow in FIG. 7 (center direction of the shaft 52*a* ) by the support member 15, the moment generated by the biasing force of the elastic member 60 does not act on the rotatable lever 16, and the rotatable lever 16 is stopped at a position shown in FIG. 7, and the support member 15 is kept down against the biasing force of the elastic member 60.

Since the rotatable lever 16 has a stopping or detent portion 16*c*, it is prevented from moving more than required. The support member 15 is forced down by the operation of the rotatable lever 16 with the fulcrum 15*a* as the center. The pressure roller 13 supported by the support member 15 is kept at a position at a predetermined distance from the heating roller 12.

The pressure roller 13 comprises a rubber layer 13*b* formed on the surface of a metal core 13*a* which is in contact with the heating roller 12 to obtain a nip width. Since rubber has a large thermal expansion coefficient and a low heat conductivity, the temperature of the pressure roller 13 gradually rises and the outer diameter of the pressure roller 13 gradually increases (broken line portion in FIG. 7) according to the operation time of the image forming apparatus 1.

Since the biasing force of the elastic member 60 is extremely large, even when the outer diameter of the pressure roller 13 becomes large, the rubber layer 13*b* is deformed and the pressure roller 13 cannot move down easily. Owing to this constitution, the contact pressure to the heating roller 12 of the pressure roller 13 or the nip width increases, thereby causing the problem of the wrinkling of the envelope.

When the amount by which the rotatable lever 16 is forced down (distance between the pressure roller 13 and the heating roller 12) is set taking into account the change in the outer diameter of the pressure roller 13 by thermal expansion to prevent wrinkling, the unfixed toner image will not be fully melt-fixed until the temperature of the pressure roller 13 is increased to a sufficient degree, a fixed outer diameter thereof is achieved and a predetermined pressure is obtained. In particular, when the thermal expansion of the pressure roller 13 is large, the heating roller 12 and the pressure roller 13 are set in a state that they do not contact each other, so that no heat is transmitted from the heating roller 12 to the pressure roller 13, making it necessary to provide a heater 14 in the pressure roller 13 as well.

That is, the wrinkling of the envelope and the melt-fixing of the unfixed toner image are contradictory and a long waiting time is required until the fixing apparatus 7 of the image forming apparatus 1 is fully warmed so as to prevent the wrinkling of the envelope and melt-fix the unfixed toner image.

SUMMARY OF THE INVENTION

It is an object of the present invention to provide a fixing apparatus capable of fixing a toner image on a recording material without wrinkling the recording material.

Another object of the present invention is to provide a fixing apparatus capable of fixing a toner image on an envelope.

Still another object of the present invention is to provide a fixing apparatus capable of changing fixing pressure.

Still another object of the present invention is to provide a fixing apparatus comprising:

a fixing rotator in contact with a recording material supporting an unfixed image;

a pressure rotator in pressure contact with the fixing rotator;

a support member supporting the pressure rotator and swingable around a plurality of fulcrums as its center;

an elastic member for biasing the support member so that the pressure rotator is biased by the fixing rotator; and pressure contact force changing means for changing pressure force by swinging the support member against the biasing force of the elastic member, wherein the pressure contact force changing means can change pressure contact force while the pressure rotator is in pressure contact with the fixing rotator.

Other objects of the present invention will become apparent from the following description.

DESCRIPTION OF THE PREFERRED EMBODIMENTS

Preferred embodiments of the present invention will be described hereinbelow with reference to the accompanying drawings.

Figure 8:
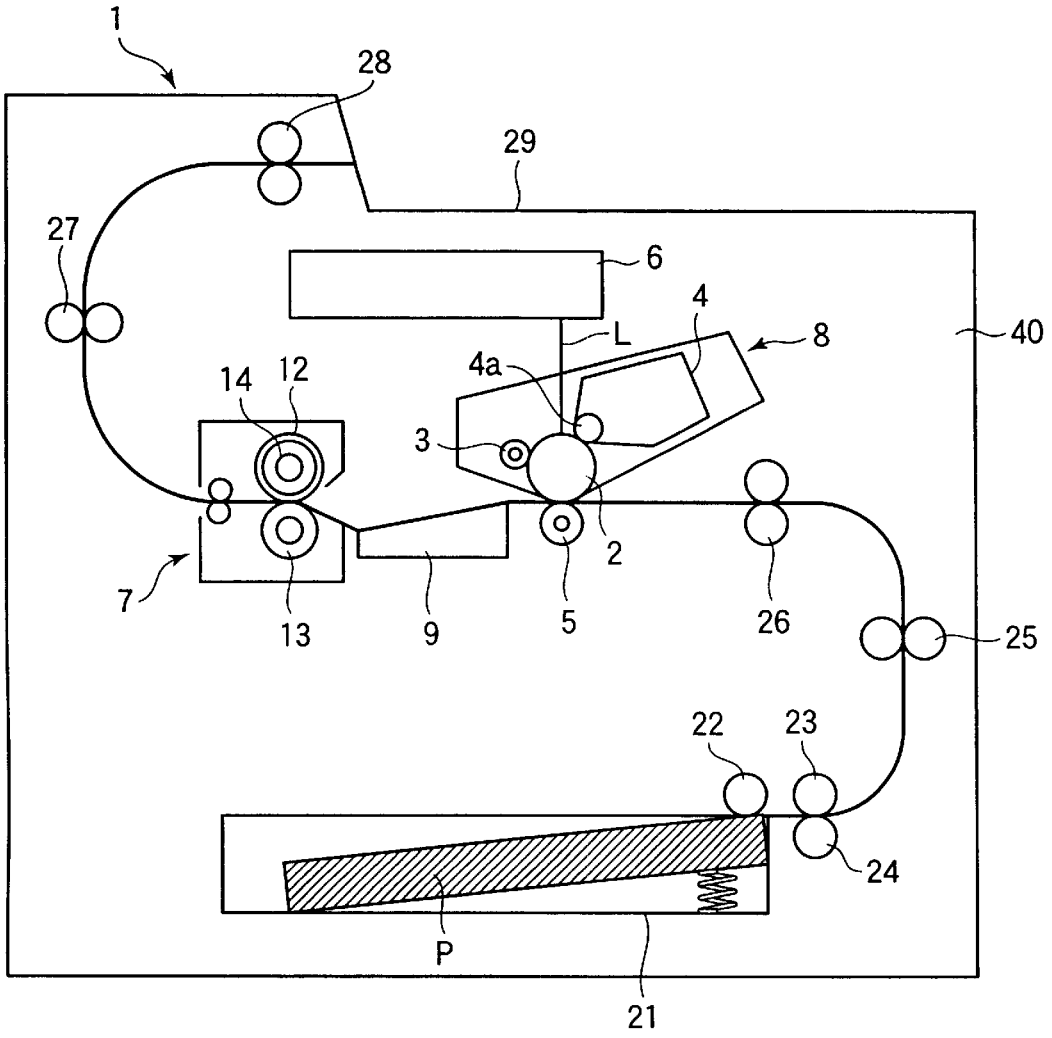
FIG. 8 is a schematic diagram showing an image forming apparatus comprising the fixing apparatus in accordance with Embodiment 1 of the present invention.

FIG. 8 is a schematic structural diagram showing an image forming apparatus (laser beam printer of electrophotographic system in this embodiment) comprising a fixing apparatus according to Embodiment 1 of the present invention.

The image forming apparatus 1 comprises a photosensitive drum 2 having a photosensitive body on its surface as an image carrier. A charging roller 3, developing apparatus 4 and transfer roller 5 are arranged around the photosensitive drum 2, and an exposing apparatus 6 is arranged above the interface between the photosensitive drum 2 and the developing apparatus 4 to form an image forming section. On a downstream side in the conveyance direction of the recording material P of a transfer nip formed between the photosensitive drum 2 and the transfer roller 5, a fixing apparatus 7 is provided through the intermediation of a conveyance guide 9. The photosensitive drum 2, charging roller 3 and developing apparatus 4 are integrated into a cartridge to form a process cartridge 8 which is detachably attached to an image forming apparatus body 40.

The photosensitive drum 2 is a negatively charged organic photosensitive body in this embodiment, has a photosensitive layer formed on an aluminum drum substrate, and is rotated in the direction indicated by an arrow (clockwise) by a driving means (not shown) at a predetermined peripheral speed (process speed) and negatively and uniformly charged by the charging roller 3 in contact with the photosensitive drum 2 in the rotation process.

The charging roller 3 as contact charging means is held in contact with the surface of the photosensitive drum 2 with a predetermined pressure to be rotated and charges the photosensitive drum 2 to a predetermined polarity or potential uniformly by charging bias applied from a charging bias power source (not shown).

The developing apparatus 4 comprises a developing sleeve 4*a* which can rotate while it is substantially in contact with the surface of the photosensitive drum 2 at a developing portion and visualizes an electrostatic latent image on the photosensitive drum 2 as a toner image by adhering toner to the latent image at the developing portion.

The transfer roller 5 as transfer means is held in contact with the surface of the photosensitive drum 2 with a predetermined pressure to form a transfer nip and transfers a toner image on the surface of the photosensitive drum 2 to a recording material P such as paper by transfer bias applied from a transfer bias power source (not shown) at a transfer nip between the photosensitive drum 2 and the transfer roller 5.

The exposing apparatus 6 forms an electrostatic latent image according to image information by outputting a laser beam (exposure beam) modulated according to the time sequence electric digital image signal of image information input from a personal computer (not shown) from a laser output section (not shown) and scanning and exposing the surface of the charged photosensitive drum 2 as indicated by symbol L.

The fixing apparatus 7 has a heating roller 12 including a heater (halogen heater) 14 and a pressure roller 13. The toner image transferred to the surface of the recording material P is thermally fixed by heat and pressure while the recording material P is conveyed and supported at a fixing nip between the heating roller 12 and the pressure roller 13. The pressure roller 13 is rotated by the rotation of the heating roller 12 driven by driving means (not shown). Details of the fixing apparatus 7 will be given below.

Next, the image forming operation of the above-mentioned image forming apparatus will be described.

At the time of forming an image, the photosensitive drum 2 is driven to turn clockwise at a predetermined peripheral speed by drive means (not shown) and charged to a predetermined potential uniformly by the charging roller 3 to which charging bias is applied. A laser beam L is applied to the surface of the charged photosensitive drum 2 by the exposing apparatus 6 for scanning whereby the potential of the scanned and exposed portion of the photosensitive drum 2 is reduced to form an electrostatic latent image according to image information input from a personal computer (not shown) or the like.

Toner is adhered to the electrostatic latent image formed on the photosensitive drum 2 by the developing sleeve 4*a* of the developing apparatus 4 to which development bias having the same polarity as the charging polarity (negative) of the photosensitive drum 2 is applied to the developing portion to visualize it as a toner image by reversal developing.

Meanwhile, the recording material P such as paper in a cassette 21 is fed by a pick-up roller 22 and conveyed to a pair of registration rollers 26 in synchronism with the formation of a toner image on the photosensitive drum 2 by a feed roller 23, retard roller 24 and feed and conveyance rollers 25. When the toner image on the photosensitive drum 2 reaches the transfer nip between the photosensitive drum 2 and the transfer roller 5, the recording material P is conveyed to the transfer nip by the pair of registration rollers 26 at this timing.

Then, the toner image on the photosensitive drum 2 is transferred to the recording material P conveyed to the transfer nip by the transfer roller 5 to which transfer bias having opposite polarity (positive) as the toner is applied by electrostatic force generated between the photosensitive drum 2 and the transfer roller 5. The recording material P to which the toner image has been transferred is conveyed to the fixing apparatus 7 through a conveyance guide 9 to thermally fix the toner image on the recording material P by heat and pressure at the fixing nip between the heating roller 12 including the heater 14 and the pressure roller 13. The recording material P having the toner image fixed thereon is fed to the surface of a sheet discharge tray 29 through a pair of conveyance rollers 27 and a pair of sheet discharge rollers 28 to complete a series of image formation operations.

The residual transfer toner existent on the photosensitive drum 2 after the above transfer is removed and collected by a cleaning apparatus (not shown).

Next, the constitution of pressure means provided on the above-mentioned fixing apparatus 7 will be described.

Figure 1:
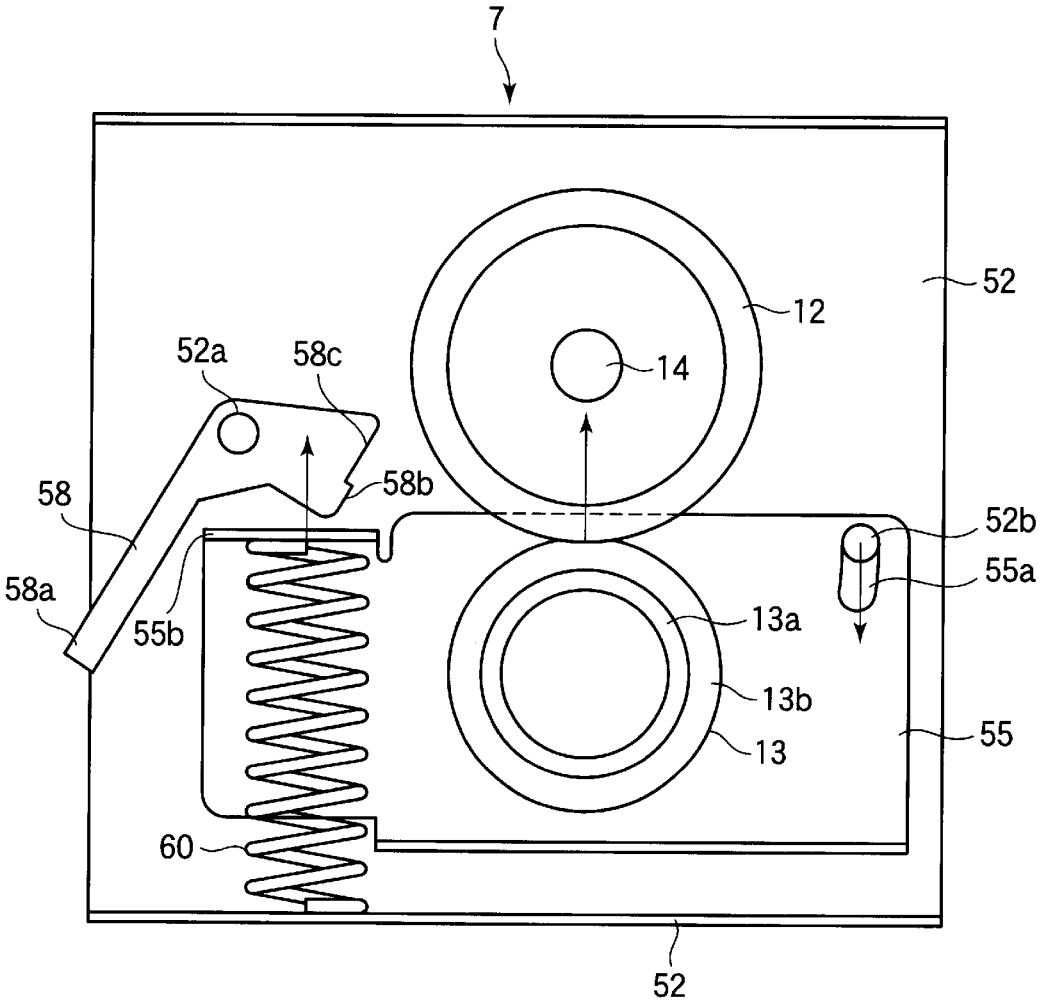
FIG. 1 is a schematic longitudinal sectional view of a fixing apparatus according to Embodiment 1 of the present invention.
Figure 2:
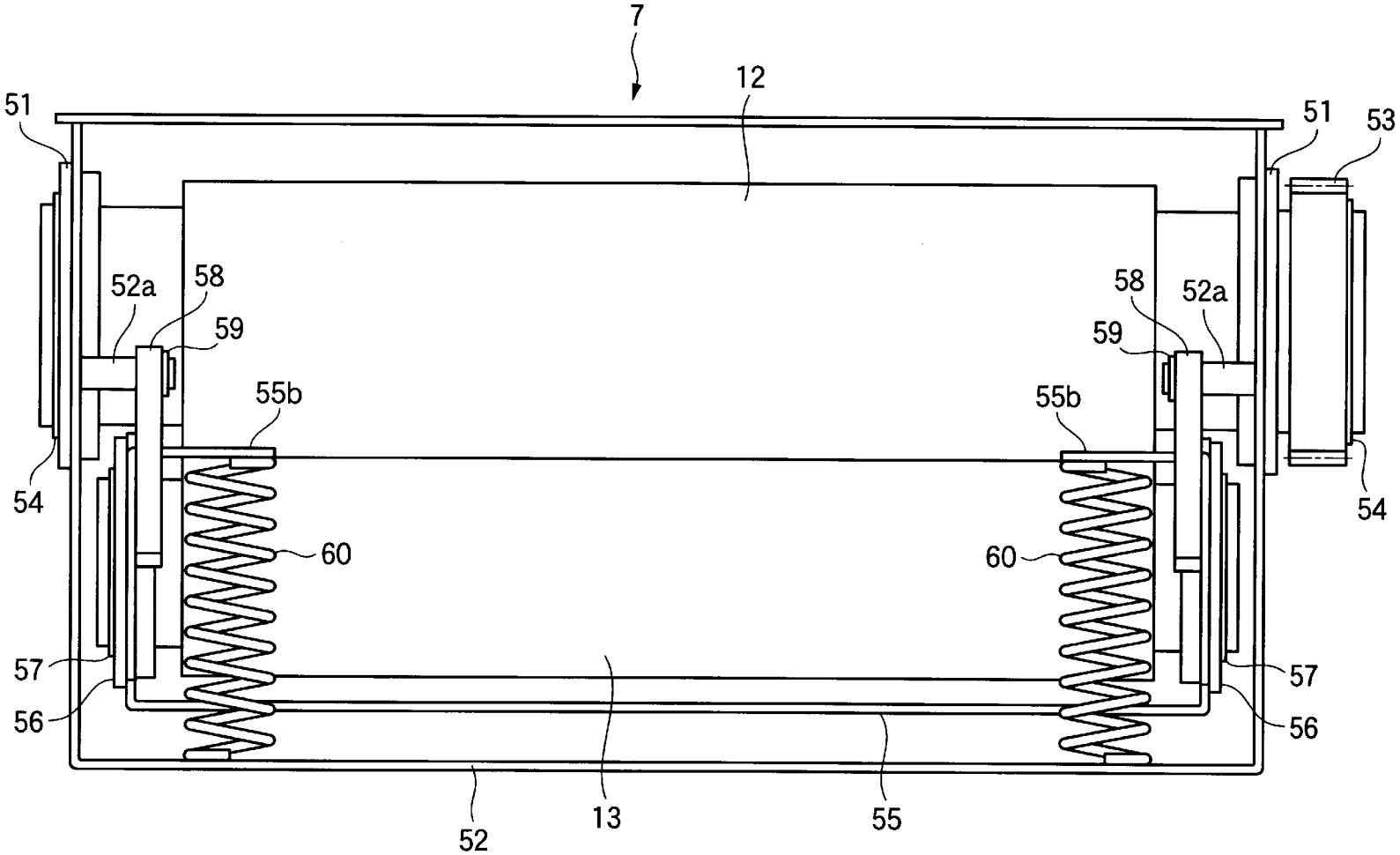
FIG. 2 is a right side view of the fixing apparatus of FIG. 1.

As shown in FIG. 1 and FIG. 2, the fixing apparatus 7 of this embodiment comprises the heating roller 12 including a heater 14 (halogen heater), the pressure roller 13 in contact with the heating roller 12 and a frame 52 for supporting these. Both ends of the heating roller 12 are rotatably supported by the frame 52 through a pair of bearings 51.

One end of the heating roller 12 is provided with a gear 53 to be driven to rotate by driving force transmitted from a drive source. Both ends of the heating roller 12 are engaged with a pair of rings 54.

Both ends of the metal core 13*a* of the pressure roller 13 are rotatably supported by a support member 55 through a pair of bearings 56 and engaged with a pair of rings 57.

Reference numeral 58 denotes a rotatable lever which may serve as contact pressure switching means and is rotatably supported by a shaft 52*a* provided on either side of the frame 52 and engaged with rings 59. The rotatable lever 58 is provided such that it can be operated manually by the operator from the outside of the image forming apparatus.

The rotatable lever 58 comprises an operation portion 58*a*, a contacting portion 58*b* which contacts the above-mentioned support member 55 and a stopping portion 58*c* for stopping the movement of the rotatable lever 58.

Denoted by numeral 60 is an elastic member which is a coil spring for biasing the support member 55 and provided between the frame 52 and the support member 55 and whose position and pressure are set to enable the pressure roller 13 to bias the heating roller 12 with predetermined pressure.

A round and long fulcrum hole 55*a* extending in substantially the same direction as the biasing direction of the elastic member 60 is formed in the support member 55, and swingably supported by a shaft 52*b* provided on either side of the frame 52. On the free end side of the support member 55 is formed a contact surface 55*b* which serves as a support portion for the elastic member 60 and as a contacting portion with the rotatable lever 58.

Subsequently, the operation of the fixing apparatus will be described with reference to FIG. 1, FIG. 3, FIG. 4 and FIG. 5.

Since the support member 55 is biased by the elastic member 60 in the direction indicated by an arrow in FIG. 1, the heating roller 12 is held in pressure contact with the pressure roller 13 and biased in the direction indicated by the arrow in FIG. 1. Therefore a reacting force in the direction indicated by the downward arrow in FIG. 1 is applied to the fulcrum hole 55*a* of the support member 55 to keep the upper portion of the fulcrum hole 55*a* of the support member 55 in contact with the shaft 52*b* of the frame 52.

Figure 3:
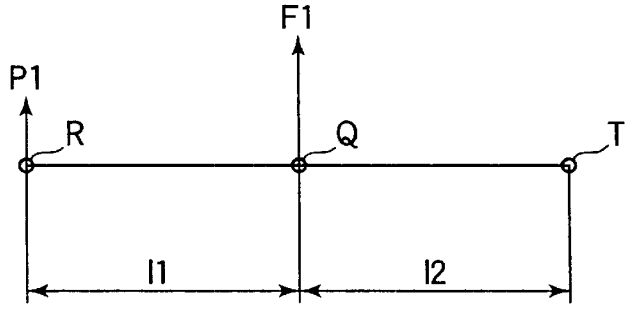
FIG. 3 is a diagram showing how force is applied in the state of FIG. 1.

A pressure contact force $F_1$ of the pressure roller 13 at this time will be schematically explained with reference to FIG. 3. A fulcrum T represents the rotation shaft 52*b* of the support member 55, a function point Q represents a nip portion between the pressure roller 13 and a heating roller 12, and the point of force R represents the contacting portion of the elastic member 60.

Assuming that the biasing force of the elastic member 60 is represented by $P_1$, the distance from the contacting portion of the elastic member to the nip portion is represented by $l_1$ and the distance PQ from the rotational shaft 52*b* to the nip portion is represented by $l_2$, the following equation (1) is obtained.

$$F_1=P_1\cdot(l_1+l_2)/l_2 \quad (1)$$

Therefore, when the paper P to which the unfixed toner image has been transferred is fed to the fixing apparatus 7, it is pressurized by this pressure contact force $F_1$ and the toner is molten by heating with the heating roller 12 so that the toner image is fixed on the paper P and conveyed.

Next, the case where an envelope is conveyed will be described.

The instruction manual of the fixing apparatus 7 teaches that when an image is to be formed on an envelope, the operation portion 58*a* of the rotatable lever 58 must be rotated downward until it cannot be rotated any more.

Figure 4:
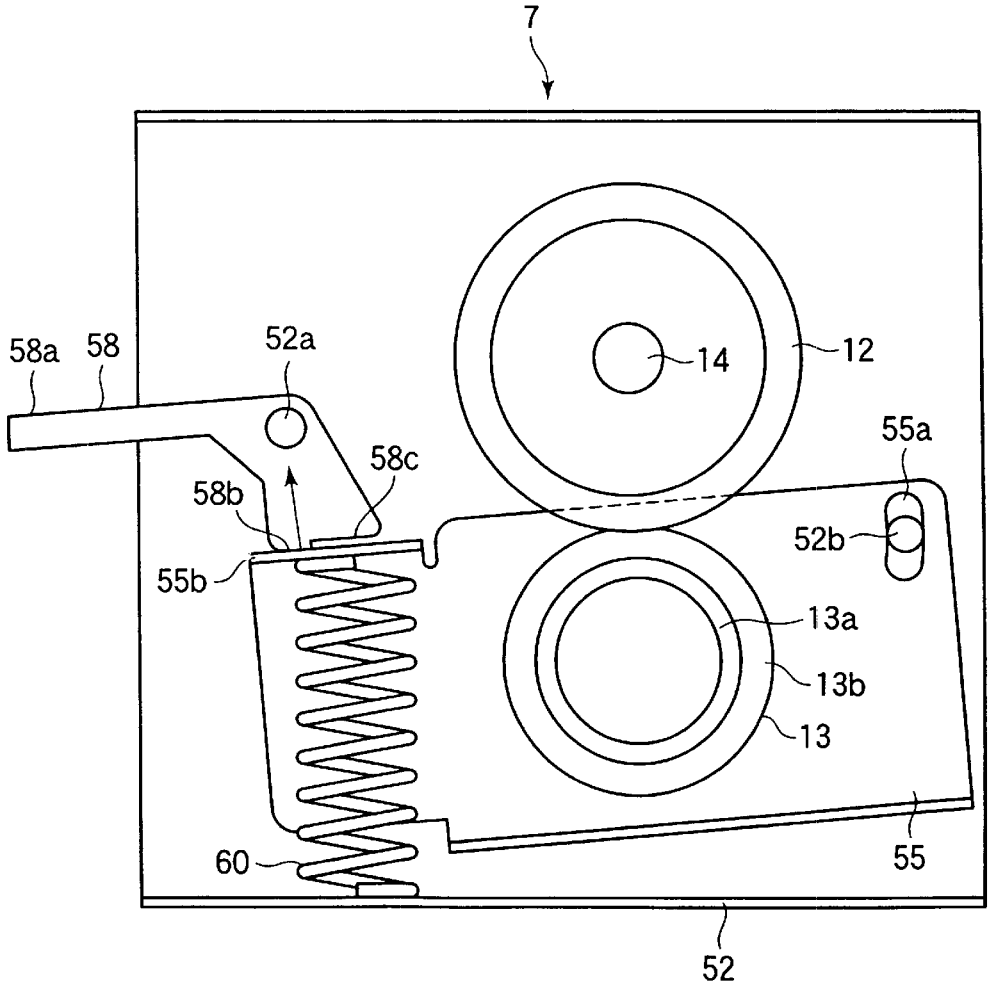
FIG. 4 is a diagram for explaining the operation of Embodiment 1 of the present invention.

The operation portion 58*a* of the rotatable lever 58 is first grasped and rotated clockwise in FIG. 1 against the biasing force of the elastic member 60 with the shaft 52*a* as the center. Then, as shown in FIG. 4, the contacting portion 58*b* of the rotatable lever 58 contacts the contact surface 55*b* of the support member 55 and the rotatable lever 58 is biased in the direction indicated by an arrow in FIG. 4 (center direction of the shaft 52*a*) by the support member 55 whereby moment generated by the resistance of the elastic member 60 does not act on the rotatable lever 58, the rotatable lever 58 is stopped at a position shown in FIG. 4, and the support member 55 is kept forced down against the biasing force of the elastic member 60. Since the rotatable lever 58 has the stopping portion 58*c*, it is not rotated more than required.

The support member 55 forced down moves such that the fulcrum hole 55*a* of the support member 55 moves along the shaft 52*b* of the frame 52 with the contacting portion 58*b* of the rotatable lever 58 as a fulcrum by the biasing force of the elastic member 60. Therefore, when the fulcrum hole 55*a* of the support member 55 is an elongated arcuate hole with the contacting portion 58*b* as the center, the support member 55 can move smoothly.

The pressure contact force $F_2$ of the pressure roller 13 at this time will be explained with reference to FIG. 5.

Since the contact portion between the rotatable lever 58 and the support member 55 functions as a fulcrum S, assuming that the biasing force of the elastic member 60 is represented by $P_2$ and the distance RS from the contacting portion 58*b* of the rotatable lever 58 to the elastic member 60 is represented by $l_3$, the following equation (2) holds true.

$$F_2=P_2l_3/(l_1+l_3) \quad (2)$$

If, for example, $l_1=l_2$ and $l_3=l_1/5$, the equations (1) and (2) can be expressed as:

$$F_1=P_1(l_1+l_2)/l_2=2P_1 \quad (1')$$

$$F_2=P_2l_3/(l_1+l_3)=P_2/6 \quad (2').$$

Since the elastic member 60 is forced down by the support member 55, the amount of deflection increases, with the result that $P_1<P_2$. Since the amount of deflection is extremely small, if $P_1=P_2$, the following equation is obtained from the equations (1') and (2').

$$F_1=12F_2$$

Therefore, when the envelope is to be conveyed, it is pressurized by reduced pressure contact force $F_2=(F_1/12)$ and the toner is melted by heating with the heating roller 12, the toner image is fixed and conveyed without wrinkling the envelope.

When printing is then carried out for a long period of time, the pressure roller 13 receives heat from the heating roller 12 and its temperature rises. Then, the rubber portion 13*b* of the pressure roller 13 expands, resulting in an increase in its outer diameter.

Figure 5:
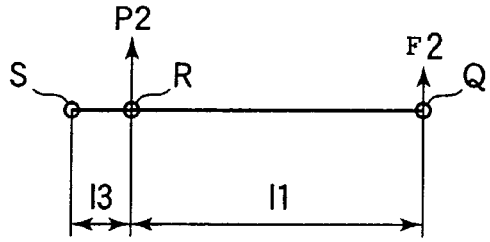
FIG. 5 is a diagram showing how force in applied in the state of FIG. 4.
Figure 6:
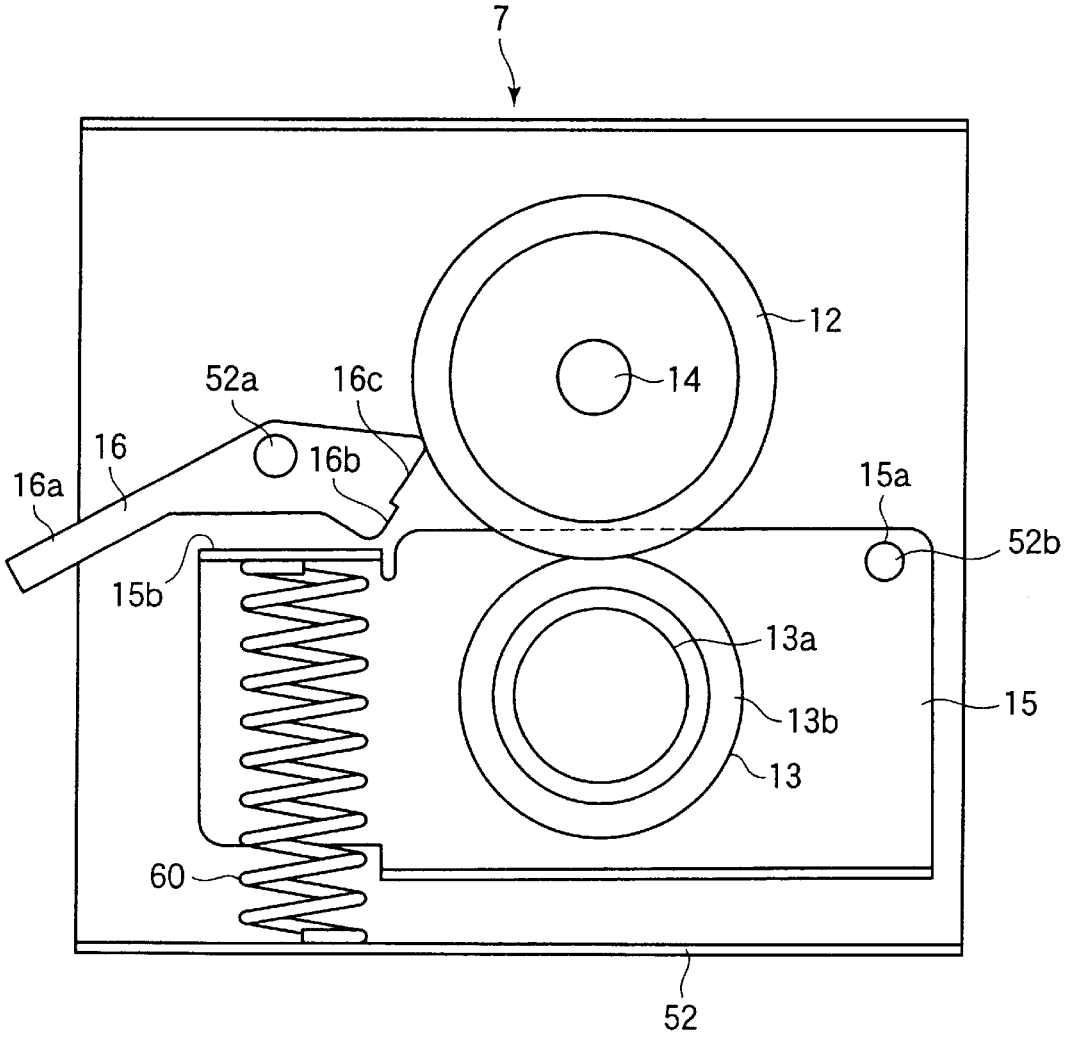
FIG. 6 is a schematic longitudinal sectional view showing an example of the fixing apparatus.
Figure 7:
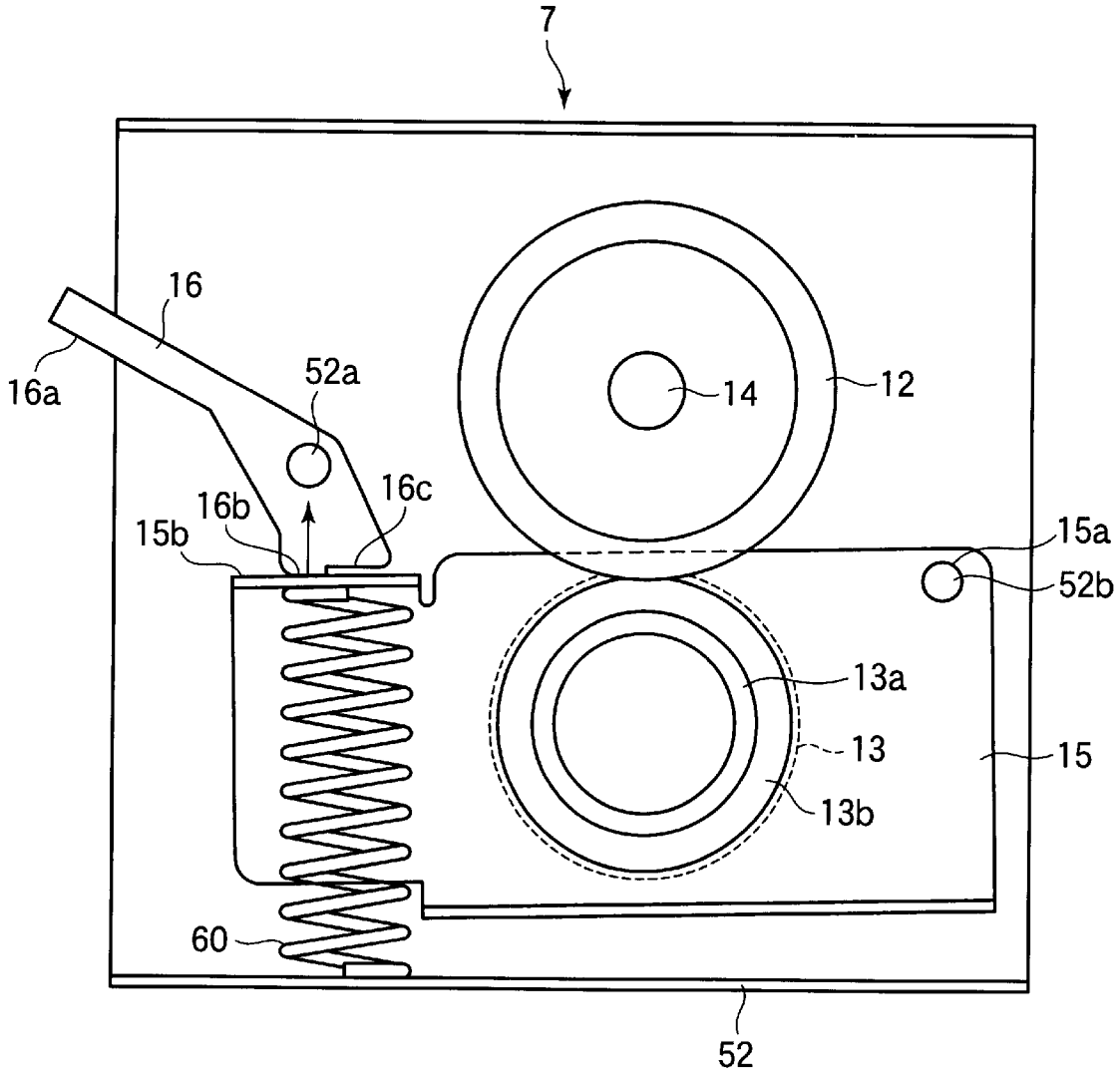
FIG. 7 is a diagram for explaining the operation of the fixing apparatus of FIG. 6.

However, according to the above-mentioned constitution, since contact pressure is small even when the pressure roller 13 thermally expands, the support member 55 can be easily turned clockwise with the fulcrum S as the center which is the contacting portion of the rotatable lever 58 as shown in FIG. 4 and FIG. 5. Therefore, pressure contact force $F_2$ scarcely changes. Also, according to the above-mentioned constitution, since the heating roller 12 and the pressure roller 13 are in contact with each other when the pressure is reduced, heat is easily transmitted to the pressure roller 13 from the heating roller 12.

That is, the time required for warming the pressure roller 13 to ensure fixability is short and the period from the time when the image forming apparatus 1 is turned on to the time when the image forming apparatus 1 can print is short.

While the fixing apparatus 7 of this embodiment is a roller fixing unit having the heating roller 12, the present invention is not limited to this and a surface fixing unit using a film or a fixing unit using an induction heater may be used. The surface fixing unit is composed of a pressure roller, a heater base provided with a heater opposing to the pressure roller and a cylindrical film which is rotatably fitted onto the heater base. In the surface fixing unit, an unfixed toner image on a recording material is brought into contact with the outer peripheral surface of the fixing film, the recording material is passed through a fixing nip between the fixing film and the pressure roller together with the fixing film, and the toner image is fixed by heat and pressure.

The fixing apparatus may be used to remove the recording material stuck in the fixing nip portion by forcing down the pressure roller 13 with the lever 58.

Embodiment 2

Figure 9:
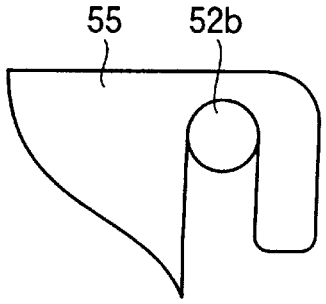
FIG. 9 is a partial view of a fixing apparatus according to Embodiment 2 of the present invention.

FIG. 9 shows Embodiment 2 of the present invention.

In the Embodiment 1, the shaft 52*b* is inserted into the elongated fulcrum hole 55*a* extending vertically and formed in the support member 55. In this embodiment, the fulcrum hole 55*a* of the support member 55 is formed as a U-shaped cut-away hole whose lower portion is open as shown in FIG. 9.

In this case, the support member 55 can be easily assembled by placing it over the shaft 52*b* of the frame 52 from above.

Embodiment 3

Figure 10:
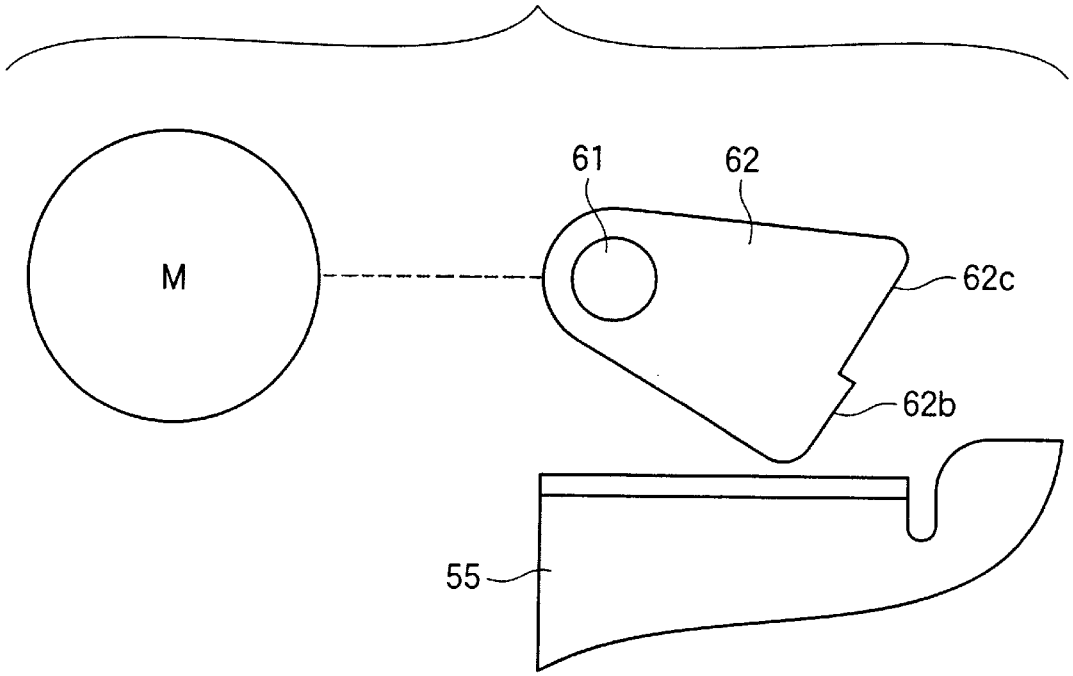
FIG. 10 is a partial view of a fixing apparatus according to Embodiment 3 of the present invention.

FIG. 10 shows Embodiment 3 of the present invention.

In Embodiment 1, the rotatable lever 58 is used as a contact pressure switching means. In this embodiment, as shown in FIG. 10, a cam member 62 which is fixed to a shaft 61 rotatable by driving force transmitted from a controllable drive source M such as a stepping motor and detecting means (not shown) for detecting the position of the cam member 62 is used to automatically force down the support member 55. Denoted by numeral 62*b* is a contacting portion and numeral 62*c* is a stopping portion.

Embodiment 4

Figure 11:
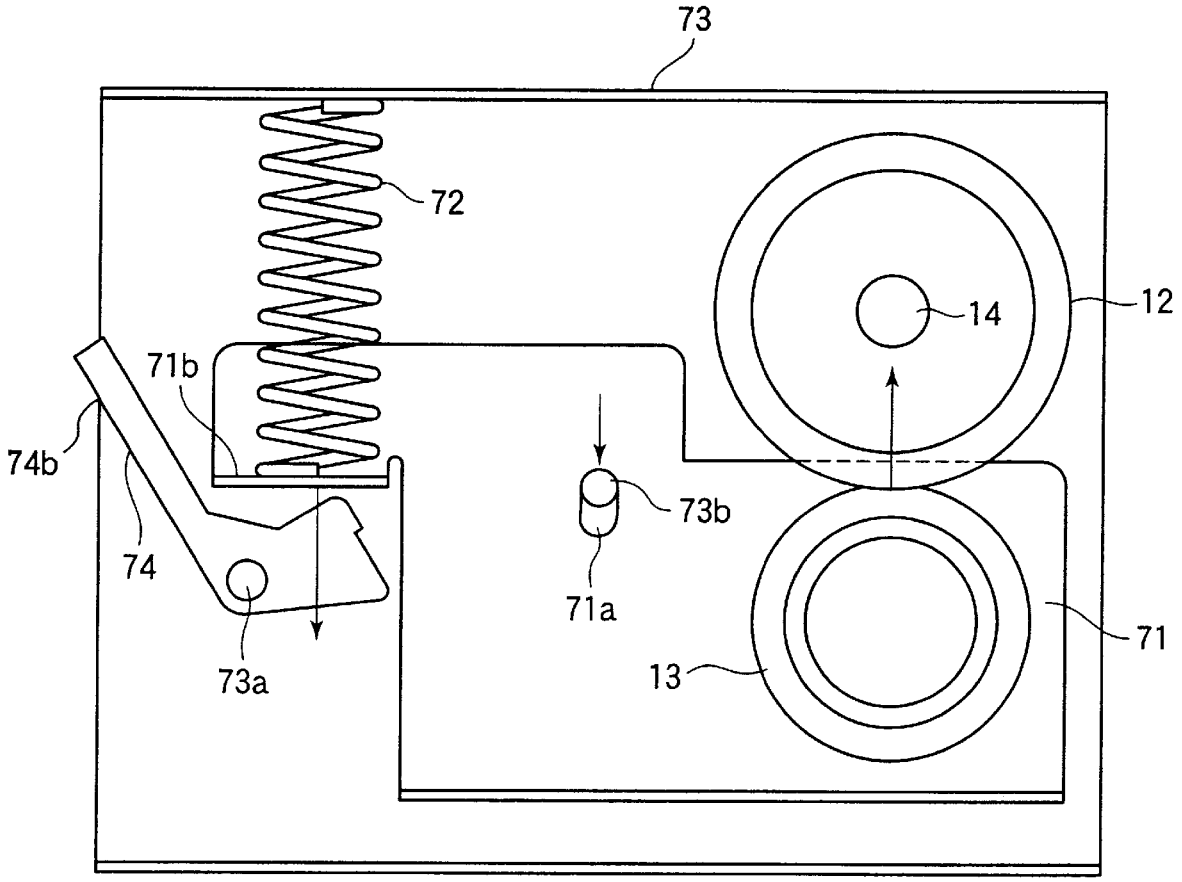
FIG. 11 is a schematic longitudinal sectional view of a fixing apparatus according to Embodiment 4 of the present invention.
Figure 12:
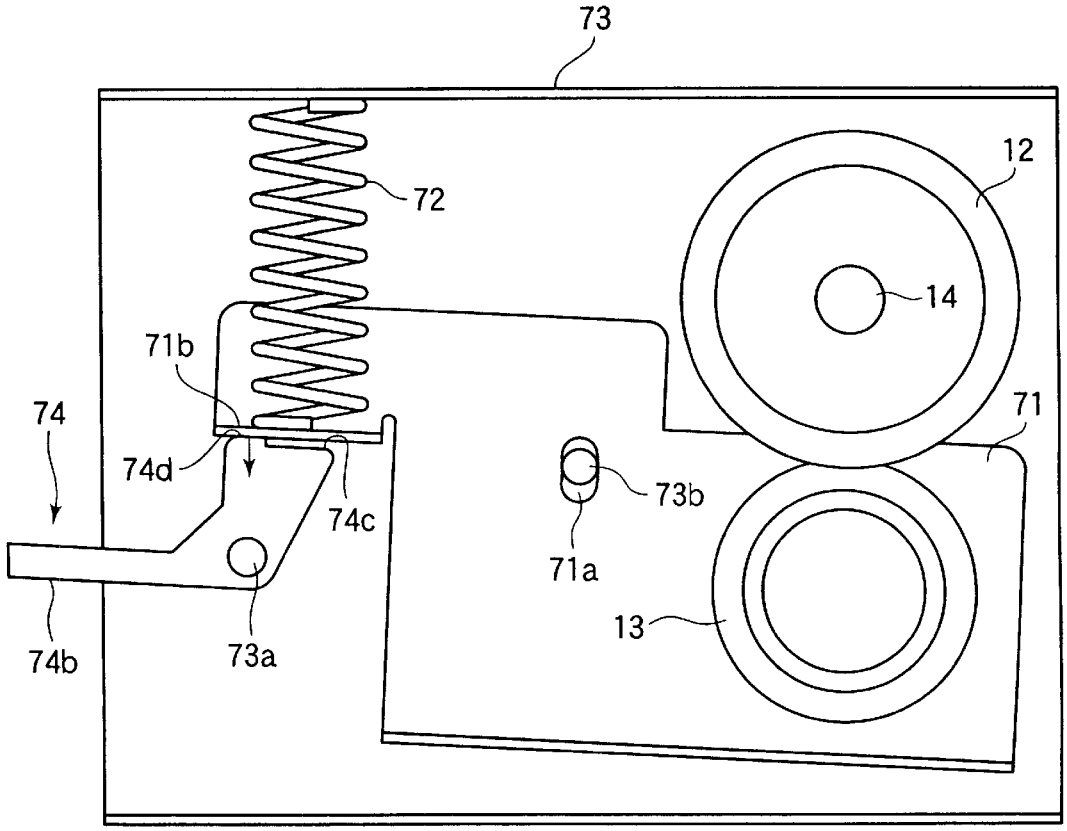
FIG. 12 is a diagram for explaining the operation of the fixing apparatus of FIG. 11.

FIG. 11 and FIG. 12 show Embodiment 4 of the present invention.

In the figures, a round elongated fulcrum hole 71*a* extending in substantially the same direction as the biasing direction of an elastic member 72 is formed in a support member 71 for rotatably supporting a pressure roller 13 between the pressure roller 13 and the elastic member 72 and swingably supported by a shaft 73*b* provided on both sides of a frame 73.

On one end side of the support member 71 is formed a bending portion 71*b* which serves as a support portion for the elastic member 72 and as a contacting portion with a rotatable lever 74. The rotatable lever 74 is rotatably supported by a shaft 73*a* provided on both sides of the frame 73.

The support member 71 is biased in a direction shown by an arrow in FIG. 11 by the elastic member 72 and the pressure roller 13 moves counterclockwise around the shaft 73*b* to pressurize the heating roller 12 with predetermined contact pressure. Therefore, a reacting force in the direction indicated by an arrow in the figure acts on the shaft 73*b* of the support member 71 and the shaft 73*b* of the support member 71 is kept at a position where it is in contact with the upper portion of the fulcrum hole 71*a* of the support member 71.

Next, the case where an envelope is conveyed will be described. An operation portion 74*d* of the rotatable lever 74 is first grasped and rotated counterclockwise in FIG. 11 against the biasing force of the elastic member 72 with the shaft 73*a* as the center. As shown in FIG. 12, since the operation portion 74*d* of the rotatable lever 74 contacts the bending portion 71*b* of the support member 71 and the rotatable lever 74 is biased in the direction indicated by an arrow in FIG. 12 (center direction of the shaft 73*b* ) by the support member 71, moment generated by the resistance of the elastic member 72 does not act on the rotatable lever 74, the rotatable lever 74 is stopped at the position shown in FIG. 12, and the support member 71 is kept down against the biasing force of the elastic member 72. Since the rotatable lever 74 has a stopping portion 74*c*, it is not rotated more than required.

The support member 71 forced down moves such that the fulcrum hole 71*a* of the support member 71 moves along the shaft 73*b* of the frame 73 by the biasing force of the elastic member 72 using the operation portion 74*d* of the rotatable lever 74 as a fulcrum.

The same effect as that in the above-mentioned respective embodiments can be obtained by the above constitution, and a motor may be used to drive the fixing apparatus as in the Embodiment 3.

As having been described above, according to the present invention, pressure contact force can be kept constant as the fixing apparatus is not influenced by the thermal expansion of a rotator such as a pressure roller at the time of reducing pressure, and it is possible to suppress the wrinkling of a material to be conveyed, such as an envelope.

Since the heating roller and the pressure roller which are, for example, a pair of rotators are always in contact with each other at the time of reducing pressure, the elevation of the temperature of the heating roller is accelerated, thereby shortening the standby period of time for printing.

While the present invention has been described in its preferred embodiments, it is to be understood that the present invention is not limited to these embodiments, and various changes and modifications may be made without departing from the scope and spirit of the invention.

What is claimed is:

1. A fixing apparatus comprising:

a fixing rotator in contact with a recording material supporting an unfixed image;

a pressure rotator in pressure contact with said fixing rotator;

a support member supporting said pressure rotator and swingable around a plurality of fulcrums;

an elastic member for biasing said support member so that said pressure rotator is biased to said fixing rotator; and pressure contact force changing means for changing a pressure contact force by swinging said support member against a biasing force of said elastic member, wherein said pressure contact force changing means can change the pressure contact force while said pressure rotator is in pressure contact with said fixing rotator, and wherein a position of the fulcrums is variable in a direction intersecting with a pressure contact force direction in accordance with a condition of activation to said support member by said pressure contact force changing means.

2. A fixing apparatus according to claim 1, wherein said pressure contact force changing means has a lever operable by an operator and changes pressure contact force by rotating the lever.

3. A fixing apparatus according to claim 1, wherein pressure contact force is reduced when the recording material is an envelope.

4. A fixing apparatus according to claim 1, wherein said apparatus has a first fulcrum for changing the pressure contact force by means of said pressure contact force changing means and a second fulcrum provided on an opposite side of the first fulcrum with said pressure rotator therebetween.

5. A fixing apparatus according to claim 4, wherein the second fulcrum is abutting on or adjacent to a contact point of said pressure contact force changing means with said support member.

6. A fixing apparatus according to claim 4, wherein said support member has an elongated hole for guiding the first fulcrum.

7. A fixing apparatus for fixing an image formed on a recording material, said apparatus comprising:

a fixing rotator;

a pressure rotator in pressure contact with said fixing rotator for forming a nip portion;

a support member for supporting said pressure rotator;

an elastic member for biasing said support member so that said pressure rotator is biased to said fixing rotator; and pressure contact force changing means for changing a pressure contact force to be applied to the nip portion, wherein said apparatus sets a first pressure contact force and a second pressure contact force smaller than the first pressure contact force, by means of said pressure contact force changing means, and a position of a fulcrum of said support member in a case of the first pressure contact force being set is different from that in a case of the second pressure contact force being set, and wherein when the first pressure contact force is set, there are aligned a contacting portion of said support member with said elastic member, the nip portion, and a first fulcrum in order, while when the second pressure contact force is set, there are aligned a second fulcrum, the contacting portion of said support member with said elastic member, and the nip portion in order.

8. A fixing apparatus according to claim 7, wherein the second pressure contact force is set when the recording material is an envelope.

* * * * *